US005274359A

United States Patent [19]

Adams

[11] Patent Number: 5,274,359

[45] Date of Patent: Dec. 28, 1993

[54] PORTABLE WATER ACTIVATED ALERT SYSTEM WITH DIRECTIONAL INDICATOR

[76] Inventor: Bruce Adams, 3705 Toulouse Ct., Punta Gorda, Fla. 33950

[21] Appl. No.: 3,651

[22] Filed: Jan. 13, 1993

Related U.S. Application Data

[63] Continuation-in-part of Ser. No. 848,674, Mar. 9, 1992, abandoned.

[51] Int. Cl.[5] ..... G08B 21/00

[52] U.S. Cl. ..... 340/604; 340/573; 340/539; 455/100

[58] Field of Search ..... 340/604, 605, 618, 620, 340/573, 539; 200/61.04; 455/100

[56] References Cited

U.S. PATENT DOCUMENTS

| | | | |
|---|---|---|---|
| 4,468,656 | 8/1984 | Clifford et al. | 340/539 |
| 4,549,169 | 10/1985 | Moura et al. | 340/573 X |
| 4,714,914 | 12/1987 | Boe | 340/620 X |
| 5,032,823 | 7/1991 | Bower et al. | 340/539 X |

*Primary Examiner*—Jeffrey Hofsass

[57] ABSTRACT

A portable water activated alert system is disclosed. The system has an RF transmitter and receiver which incorporate special features. Both are battery operated and portable. The receiver includes both an audible alarm and an illuminated directional and proximity indicator.

11 Claims, 1 Drawing Sheet

PORTABLE WATER ACTIVATED ALERT SYSTEM WITH DIRECTIONAL INDICATOR

RELATED APPLICATION

This application is a continuation in part of U.S. Ser. No. 848,674, filed Mar. 9, 1992, now abandoned.

BACKGROUND OF THE INVENTION

The present invention relates to a portable water activated alert system, with a transmitter and a receiver equipped with a directional indicator. For many years, garage door openers have been activated by means of RF transmitters. These units generally operate in the 300 megahertz range. The more sophisticated units use an encoded signal. These transmitters and receivers lend themselves to the basic principals of the present invention. Advances in battery technology and systems have led to the development of physically compact and efficient batteries that store a relatively large amount of electrical energy. These higher energy batteries have permitted the development of higher power cordless devices that operate at power levels above 50 watts, including power levels that extend to 500 watts or more. These higher devices include for example portable hand held power tools, cordless phones and electric shavers.

SUMMARY OF THE INVENTION

The present invention provides a portable water activated alert system with a directional indicator mounted on top of the receiver to aid in locating someone or something that has come in contact with water. This invention is intended to be an aid in the prevention of injury or death by accidental drowning. The transmitter is intended to be used as a water contact alert to be affixed to a piece of clothing, collar, belt or other means. Once actuated, the transmitter will send the encoded signal to the receiver. The receiver will indicate the direction of signal origin by means of the LED directional indicator which consists of groups of LEDs arranged in a star-like configuration. The signal strength as received by the antenna array and relayed to the respective group of LEDs will determine the number of LEDs to be activated whereby indicating proximity to transmitter. This novel feature allows the receiver to be used at night.

The transmitter will be contained in a water-tight housing constructed of two halves formed by molded plastic of low dielectric constant joinable by means of a threaded coupling and sealed with a replaceable "O" ring. The sensor that enables the transmitter shall be any type that is activated by immersion in water (i.e. probe, galvanic, water sensitive resistor etc.) A low level battery indicator, consisting of an LED that flashes when the battery cell needs to be replaced, will be incorporated, insuring system reliability.

The receiver is designed to latch on an audible alarm after the encoded signal has been received and verified. This incoming signal is also utilized by the receiver to display the relative position of the transmitter to the receiver. Because of the unique portability, the receiver can be removed from the base and used as a directional finder to aid in locating the transmitter.

So as to keep the receiver portable, the base of the unit is powered from a 110 volt AC supply that converts to regulated DC current. For use on boats or where AC voltage is not readily available, a 12 volt base will be used, affording greater flexibility. An LED is used to indicate proper function of the base charging unit and thus maintains the battery in the receiver unit at full potential. This unique feature serves three distinct functions. (1) It allows the receiver to be portable; (2) It keeps the system active in the event of a power failure; and (3) It allows the receiver to be carried toward the transmitted signal as a directional finder.

This system could be utilized by people who live on or by water such as a pond, a lake, a pool or canal. The invention could be utilized on board a boat allowing rapid knowledge of the direction and location of a child, person or thing which has fallen overboard.

DETAILED DESCRIPTION OF PREFERRED EMBODIMENTS

Figure 1:
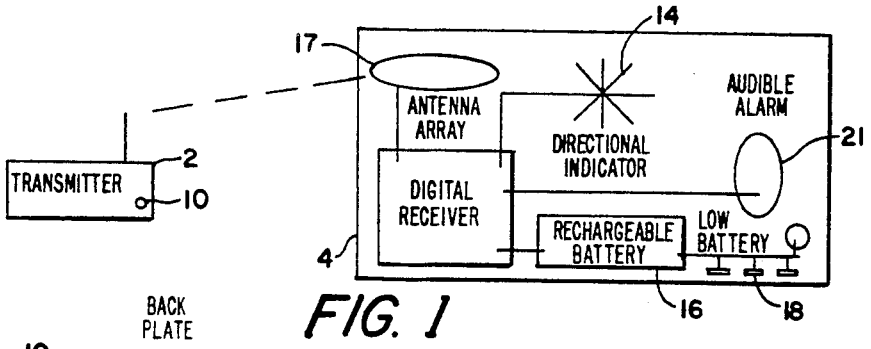
FIG. 1 is a schematic representation of an associated transmitter and receiver equipped with an audible alarm and directional indicator.
Figure 2:
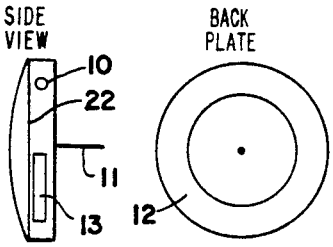
FIG. 2 is an illustration of an alternative transmitter with a fastening device.
Figure 4:
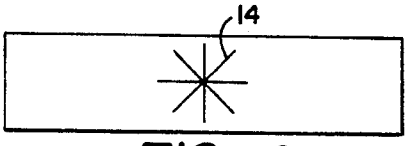
FIG. 4 is an illustration of the LED directional indicator.

The portable water activated alarm of this invention, FIG. 1, includes a transmitter 2, and a receiver 4. A preferred transmitter 2*a*, FIG. 2, is portable and constructed of two halves using a threaded coupling and an "O" ring 22 to accomplish a water-tight seal. Transmitter 2*a* is equipped with a special fastening device 11 which connects to a removable back plate 12, which is childproof. The encapsulated transmitter 2*a* includes a battery 13 for a power source and an LED low power level indicator 10.

Figure 3:
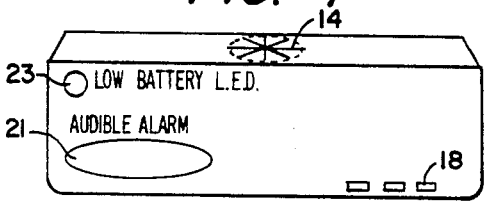
FIG. 3 is an illustration of the receiver with a few of the components that are novel to the invention.

The receiver 4, shown alone in FIG. 3, includes a rechargeable battery 16 for its power source. This power source is maintained through contacts 18 located at the bottom of the receiver. The receiver is equipped with a novel LED display 14 arranged in such manner as to provide both direction and proximity to the transmitter. The antenna array 17 designed into the receiver will provide segmented signal level information which is then transposed to the LED directional display 14. An audible alarm 21 and low power level LED 23 complete the major components of the receiver.

Figure 5:
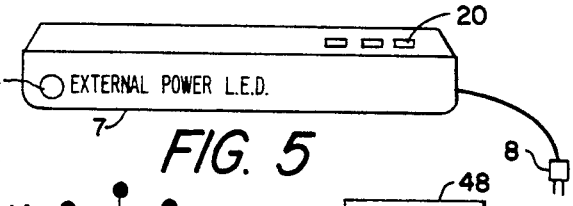
FIG. 5 is an illustration of the base power supply.

A base unit 7, FIG. 5, is energized by a conventional AC plug 8. Base unit 7 is equipped with contacts 20 that correspond to and communicably engage receiver contacts 18 to establish a path of electrical interconnection from the base unit to the battery in the receiver. The base unit also houses a converting power supply for changing the incoming voltage to the requirement needed for the receiver and an LED indicator 24 to verify the presence of external power.

Figure 6:
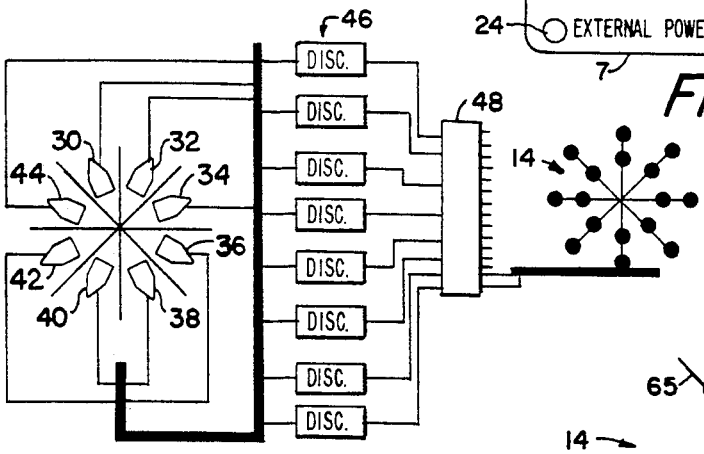
FIG. 6 is a schematic view of a preferred antenna array, directional display and associated circuitry.

As shown in FIG. 6, antenna array 17 includes shield and antenna segments 30, 32, 34, 36, 38, 40, 42, and 44. Each segment responds to the transmitted signal by providing an output signal to a respective one of discriminators 46. A microprocessor 48 receives outputs from the discriminator and energizes LED display 14 to indicate the relative direction and intensity of the sent signal.

Figure 7:
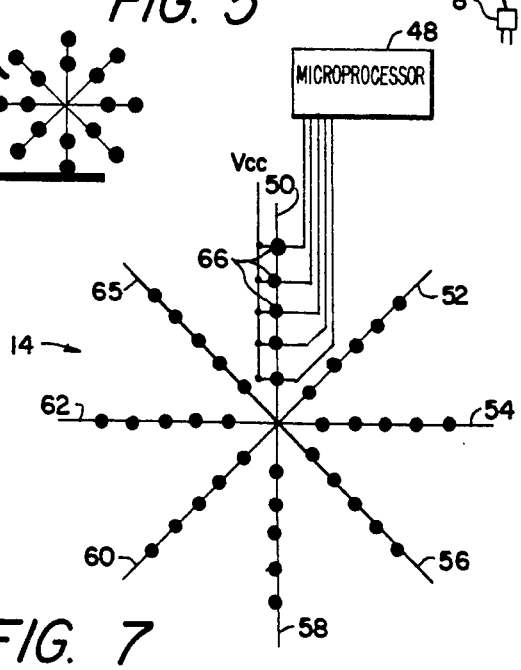
FIG. 7 is a schematic view of the directional display and the means for interconnecting it to the microprocessor.

More particularly, as illustrated in FIG. 7, display 14 includes eight groups of LEDs 50, 52, 54, 56, 58, 60, 62 and 64, that correspond with general directions. Each group (for example group 50) includes a series of individual LEDs 66 that are individually interconnected to microprocessor 46. Outputs from the antenna segments 30-42 are processed by the discriminators 46 and microprocessor 48 to energize one of the groups 50-64, thereby providing an indication of the general direction of the signal from the transmitter. Additionally, the output from discriminators 46 is processed by microprocessor 48 to determine intensity of the transmitted signal. Specifically, microprocessor 48 responds to this output by energizing a number of LEDs corresponding to a particular relative intensity. For example, as the intensity of the transmitted signal increases, microprocessor 48 biases on an increasing number of LEDs in the group representing the general direction of the transmitted signal.

What is claimed is:

1. A portable water contact activated alert system with directional and proximity capability comprising:

digital transmitter means for sending a signal, said transmitter means having a replaceable battery power source encapsulated in a water-tight housing and further having an attached childproof fastening device and an exposed water sensing element for enabling said transmitter means;

a portable receiver having a rechargeable battery power source, digital receiver means for detecting and verifying said signal from said transmitter means, means for indicating the direction and intensity of said signal, and an audible alarm, each of which is enclosed within a case, said means for indicating including multiple linear groups of energizable leds arranged in a radial pattern, each individual group corresponding to a respective general direction, each of the leds within said group individually corresponds to a respective level of signal intensity, said receiver means being responsive to detection of said signal for energizing at the lowest intensity at least one of said leds within the corresponding group thereby indicating both direction and intensity of said signal, as the said intensity increases more of the leds within said group are energized; and a base unit containing contacts for interfacing with corresponding contacts carried by said portable receiver, for maintaining said rechargeable battery source in said receiver in a ready state of charge, said base unit further including a power supply for activating said base unit.

2. The device of claim 1 in which said transmitter means include a low power level LED indicator, which is encapsulated in said housing.

3. The device of claim 1 in which said portable receiver includes a low power level LED enclosed in said case.

4. The device of claim 1 in which said base includes a power-on LED indicator.

5. The system of claim 1, wherein the water-tight housing for said transmitter is constructed of two halves formed by molded plastic of low dielectric constant joinable by means of a threaded coupling and sealed with a replaceable "O" ring.

6. The system of claim 1, wherein said transmitter unit has a visible LED to indicate low power state of replaceable battery.

7. A system of claim 2, wherein the housing is equipped with a fastening device children can not easily unfasten; consisting of a back plate that requires simultaneous pressure and rotation to accomplish removal.

8. A system in accordance with claim 1, wherein said receiver utilizes a self-contained rechargeable battery allowing portability and continuous operation when interruption of external power takes place.

9. A device in accordance with claim 1, wherein the receiver is equipped with a low power level LED indicating the state of charge of the battery.

10. A system in accordance with claim 1, wherein the base unit comprises: a means for converting 110 volt current or an external 12 volt supply, depending upon the application, to provide a regulated DC voltage.

11. A device in reference to claim 10 wherein an LED is included with said base unit to indicate that external power is present at said base unit.

* * * * *